United States Patent [19]

Mihara

[11] Patent Number: 4,682,909

[45] Date of Patent: Jul. 28, 1987

[54] PAVED ROAD SURFACE REPRODUCING APPARATUS

[75] Inventor: Tohru Mihara, Kyoto, Japan

[73] Assignee: Taisei Road Construction Co., Ltd., Tokyo, Japan

[21] Appl. No.: 787,674

[22] Filed: Oct. 15, 1985

[51] Int. Cl.[4] ..... E01C 23/12

[52] U.S. Cl. ..... 404/90; 404/91; 404/95

[58] Field of Search ..... 404/90, 95, 91, 92, 404/101; 414/498

[56] References Cited

U.S. PATENT DOCUMENTS

| | | | |
|---|---|---|---|
| 3,451,572 | 6/1969 | Rossoni | 414/498 |
| 3,970,404 | 7/1976 | Benedetti | 404/90 X |
| 3,989,401 | 11/1976 | Moench | 404/90 X |
| 4,018,540 | 4/1977 | Jackson, Sr. | 404/95 |
| 4,124,325 | 11/1978 | Cutler | 404/90 X |
| 4,226,552 | 10/1980 | Moench | 404/91 X |
| 4,319,856 | 3/1982 | Jeppson | 404/95 X |
| 4,534,674 | 8/1985 | Cutler | 404/90 X |

*Primary Examiner*—Stephen J. Novosad

*Assistant Examiner*—Matthew Smith

*Attorney, Agent, or Firm*—Cushman, Darby & Cushman

[57] ABSTRACT

The paved road surface reproducing apparatus consists of first and second self-propelled, steerable working trucks. The first truck is equipped with: a road surface heater; a pair of gas cylinder tables mounted on both sides of the truck which can be raised or lowered by lifts; a hopper for receiving a bituminous mixture from outside; and a conveyor for transporting the mixture form the hopper to the rear part of the truck. The second truck is equipped with: a hopper for receiving the bituminous mixture transferred from the first truck; a conveyor for transporting the mixture received from the hopper to the rear part of the truck; a powdery oil-absorber scattering device to minimize rutting; a small size road surface heater; a scarifier; a softening agent scattering device; and a rotor; and also equipped with a first screw spreader; a first screed; a second screw spreader; and a second screed in tandem at the rear part of the truck. The first screw spreader and the first screed are mounted on the truck to have its lower end faces to be submergible under the surface of the road.

1 Claim, 8 Drawing Figures

PAVED ROAD SURFACE REPRODUCING APPARATUS

BACKGROUND OF THE INVENTION

The present invention relates to a paved road surface reproducing apparatus for remedying a road paved with a bituminous material at the site.

Generally speaking, the paved road having its bituminous material had aged to lose its paving function is remedied so as to prevent a danger to the runs of vehicles or environmental pollution of the roadsides. The remedy of the bituminized road has been conducted in the prior art by one of the method of digging the paved road to its full thickness to repave the dug road with a new material, the method of cutting away only the portion having lost the paving function to repave the cut portion with a new bituminous mixture, the method of raising the paved road merely with a new bituminous mixture, or the method of executing the remedy by individually using several machines such as a road surface heater, a scarifier, a screed or a roller. However, these engineering methods are followed by several problems that the time for the remedy is elongated, that the remedy is troubled by noises, that it is difficult to retain places for disposing the pavement wastes forming part of industrial wastes, and that those many machines are required to make the works inefficient and to raise the pavement cost.

In order to solve these problems, the present applicant has heretofore proposed a heating type bituminized road surface reproducing apparatus which has an effect that it can heat and scarify the road to effect the remedy by itself at the site for a short time period with inviting neither the noises and vibrations nor the industrial wastes to reproduce a paved road with economy of power and resources. Thus, in the case of the repaving method in which the bituminized road is overlaid by the bitumen, in order to transport, level, finish and tamp the new bituminous mixture, a dump truck, an asphalt finisher, a roller and so on are used to raise the problems that the many machines are required for individual works and that the cost for the remedy is raised. Since the new bituminous mixture has to be unloaded from the dump truck in accordance with the relatively slow working speed of said reproducing apparatus, moreover, this apparatus is followed by the problems that the working efficiency of said dump truck and the subsequent standby truck is bad and that the temperature drop of the new bituminous mixture is invited to deteriorate the tamping percentage of the bituminized road. In the overlaying case of that reproduced paved road at the site where the remedy is conducted at one side of the road while traffic is allowed at the other roadside, both the long line of those working machines including the standby dump truck or trucks and the intrusion of the dump truck having gained its turn into the working site in front of the reproducing apparatus raise problems that the ordinary traffic is remarkably obstructed and that the heated mixture and road surfaces have their temperatures dropped. On the other hand, the aforementioned heating type bituminized road surface reproducing apparatus has a problem that it finds it difficult to adopt the remixing method by which the bituminous mixture reproduced at the site is mixed with a new one.

In accordance with the prior art, the heating type bituminized road surface reproducing apparatus is equipped: in an upper front portion of its self-propelled body with a hopper for receiving a paving material; below the hopper with a bar feeder for feeding the paving material backward; below the center of the body with a scarifier for digging up the paved road and a rotor for breaking up the paved road dug up; and in a rear lower portion of the body with a screw spreader for spreading the paving material to have a predetermined width and thickness and a screed for tamping the paved road.

However, the aforementioned heating type bituminized road surface reproducing apparatus of the prior art is accompanied by the following problems when it digs up the paved road by the scarifier, breaking up the dug road by the rotor, feeds a new paving material backward from the hopper, levels the material by the screw spreader, and tamps the same by the screed.

It is ordinary to slope the widthwise center of the road surface upward, and there arises a difficulty that the paving material to be fed backward by the bar feeder drops in front of the screw spreader so that it flows out forward and sideway of the road surface before it is tamped by the screed.

This difficulty is severe especially in case the roadsides are formed with side grooves so that the paved surface is dug from above the side groove frames. This is because the screed has its lower face leveled with the upper faces of the side groove frames whereas the screw spreader is positioned above the face of the screed so that the soft asphalt mixture flows forward below the screw spreader until it flows down to the roadsides in accordance with the slope of the road surface. This outflow of the paving material to the side grooves makes the post-treatment difficult.

SUMMARY OF THE INVENTION

The present invention has been conceived so as to solve the aforementioned problems and has an object to provide a paved road surface reproducing apparatus which can execute the reproduction economically for a short time period without any environmental pollution with little obstruction to the general traffic and little drop of the temperatures of the heated mixture and road surface and which can execute not only the socalled "reforming method" of reproducing the bituminized road at the site but also both the remixing method of scattering an additive by using either powdery oil-absorber scattering means for the ruts, which are caused by asphalt excess for the traffic load or liquid softening agent scattering means when the asphalt has aged to form cracks the repaving method of using a new mixture when the paved thickness is short.

Another object of the present invention is to provide a paved road surface reproducing apparatus which has its second working truck equipped with two pairs of higher and lower screw spreaders in a rear portion of the truck body.

According to a major feature of the present invention, there is provided a paved road surface reproducing apparatus which is equipped with two pairs of screw spreaders and screeds so that a primary treatment may be executed by the front one pair. More specifically, the paved road surface reproducing apparatus is equipped with a scarifier and a rotor and is characterized to have its body arranged in tandem in its rear portions with a first screw spreader, a first screed, a second screw spreader, and a second screed such that they are ordered backward of the apparatus body, as recited, and such that the first screw spreader and the first screed are enabled to have their lower end faces submerged below the road surface.

According to the present invention thus constructed, the first screw spreader and the first screed can be submerged below the road surface. When a new paving material is to be placed after the scarifier has had its leading end submerged to dig up the road surface and after the rotor presses and stabilizes the paved surface below the upper face of the side groove, the first screw spreader primarily spreads the new paving material to a predetermined width and thickness, and the first screed primarily tamps the spreaded material to prevent the same from flowing to the road side until the second screw spreader and the second screed secondarily completes the leveling and tamping.

BRIEF DESCRIPTION OF THE DRAWINGS

Other objects, advantages and features of the present invention will become apparent from the following description taken with reference to the accompanying drawings, in which.

DESCRIPTION OF THE PREFERRED EMBODIMENT

Figure 1:
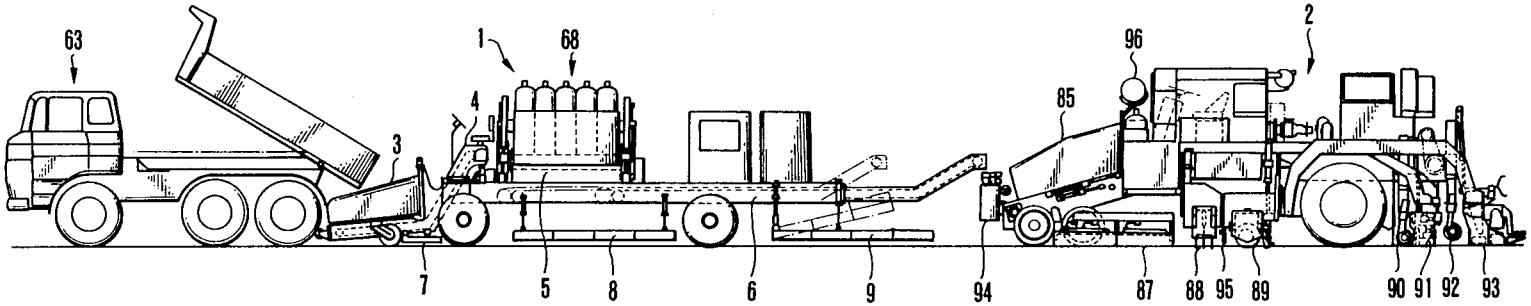
FIG. 1 is a side elevation showing a paved road surface reproducing apparatus according to the present invention.
Figure 2:
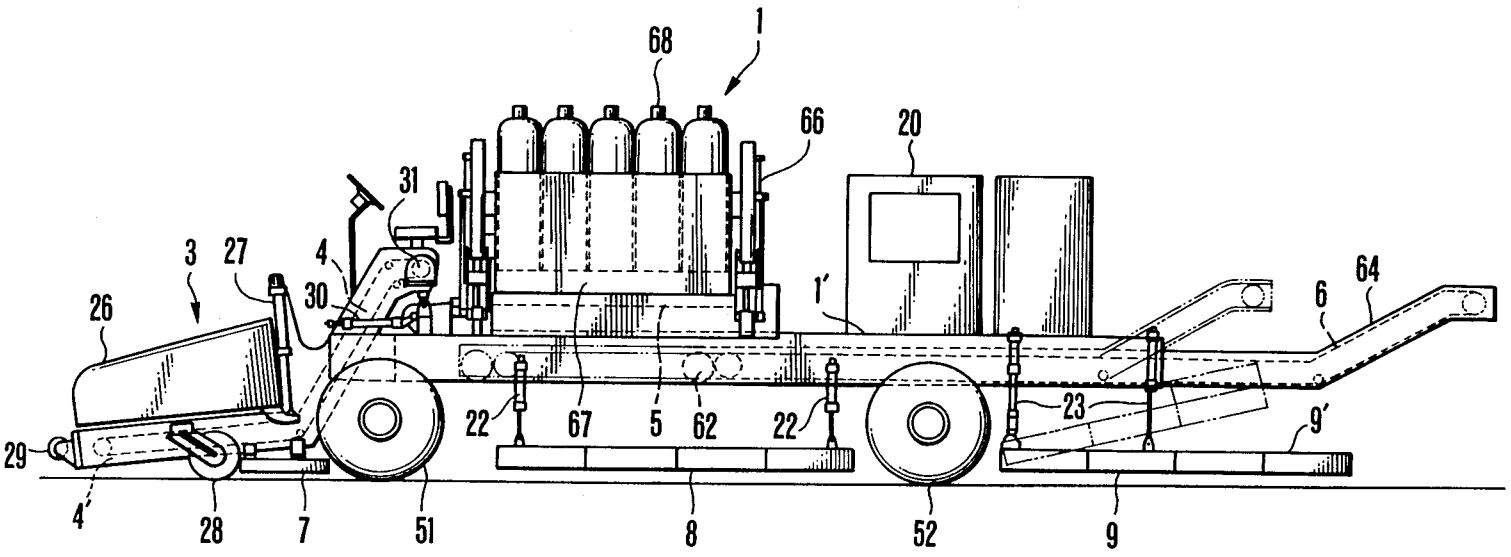
FIG. 2 is a side elevation showing a first working truck.
Figure 3:
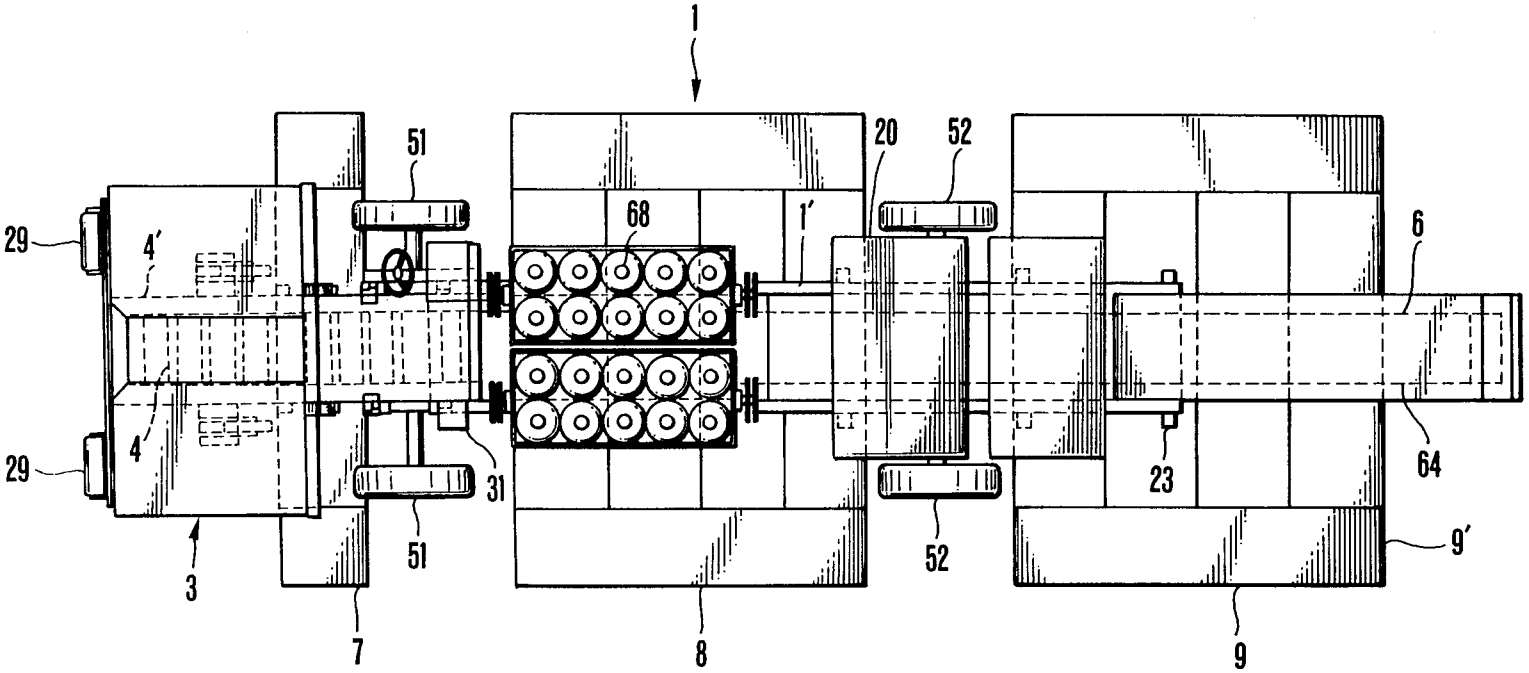
FIG. 3 is a top plan view showing the same.
Figure 4:
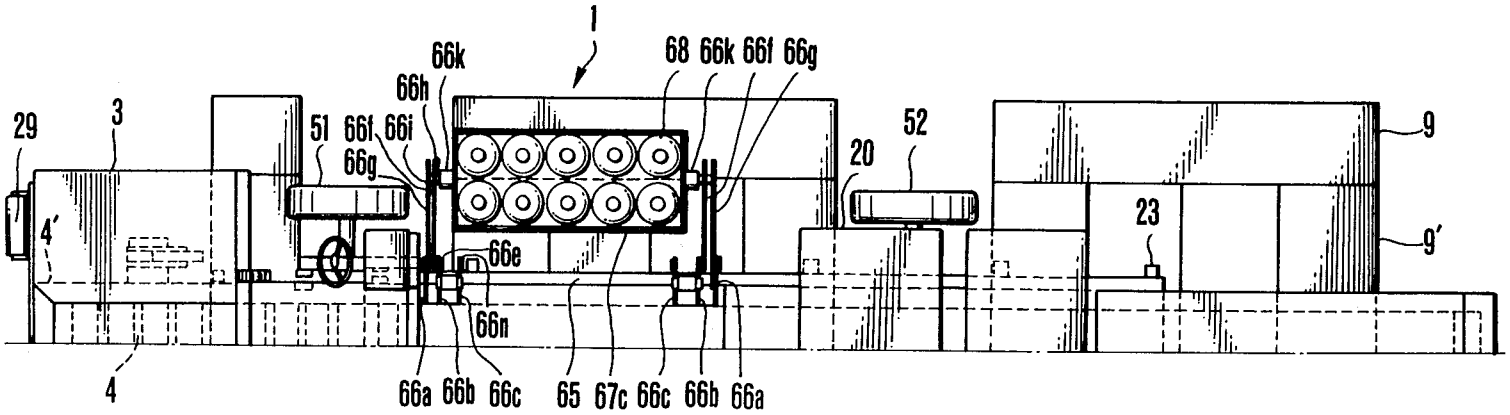
FIG. 4 is an enlarged view showing the righthand half of FIG. 3, as viewed in the running direction.

The present invention will be described in the following in connection with the embodiment thereof with reference to the accompanying drawings.

The paved road surface reproducing apparatus is constructed of first and second working trucks 1 and 2 which are self-propelled and made steerable by engines 20 and 21.

The first vehicle 1 is equipped at its front portion with a first hopper 3 for receiving a new bituminous mixture from a dump truck 63 or another transporting vehicle. The first hopper 3 is composed of two side plates 26, a bar feeder 4, and the running frame 4' of the bar feeder 4. The running frame 4' has its rear end portion hinged to the body 1' of the first vehicle so that the first hopper 3 is enabled to run together with the first vehicle 1 by casters 28 borne on the bottom surface of the running frame 4'. Indicated at reference numeral 29 are abutment rollers which are fixed on the leading end portion of the first hopper 3. These abutment rollers 29 are brought into abutment against the tires of the dump truck 63, when the bituminous mixture is supplied to the first hopper 3, to make constant the distance from the dump truck 63. Moreover, the first hopper 3 can be tilted by means of a cylinder 30 attached to the body 1' so that its casters 29 may float apart from the road surface for convenience of transportation when the first vehicle 1 is to be transported, loaded, unloaded or forwarded. The bar feeder 4 is mounted under tension from the bottom of the front portion of the first hopper 3 to above the front end portion of a first belt conveyor 5 overlying the truck body 1' and is driven by a motor 31 to convey the bituminous mixture poured from the dump truck 63 onto the first belt conveyor 5. On the other hand, the first hopper 3 has its two side plates 26 winged by a cylinder 27 to adjust the receiving and dropping speeds of the bituminous mixture supplied from the dump truck 63.

To the rear end of the bottom of the first hopper 3, there is fixed a first road surface heater 7 which is arranged in parallel with the road surface. Front wheels 51 are borne on both the sides of the truck body 1' at the back of the first hopper 3. From the lower face of the body 1' at the back of the front wheels 51, there are vertically movably suspended a second road surface heater 8, which is located in the vicinity of the longitudinal center of the body 1', by means of four cylinders 22. Other but additional heaters are removably attached to the two sides of the body of a heater having substantially the same width as that of the first vehicle 1 so that they can be widened in accordance with the paving width. Rear wheels 52 are borne on both the sides of the body 1' at the back of the additional heaters. On the other hand, a third road surface heater 9 is vertically movably suspended, while having its portion 9' protruding backward of the body 1', by means of a cylinder 23 such that its protruding portion 9' can be folded and freely widened like the second road surface heater 8.

On the other hand, the first belt conveyor 5 is disposed to extend from below the rear end portion of the bar feeder 4 to the central portion of the body 1' whereas a second belt conveyor 6 is disposed under tension while having its leading end protruding to below the rear end portion of the first belt conveyor 5 and its lead end protruding backward of the rear end portion of the body 1'. Moreover, the second belt conveyor 6 is driven to run in a running frame 64, which is borne on the body 1' by rollers, by a drive motor 62 placed on the running frame 64, so that it can be slid together with the running frame 64 and the drive motor 62 back and forth of the body 1' by a drive mechanism such as a hydraulic cylinder. In the working operations, the second belt conveyor 6 slides backward to have its rear end portion protruding, and, when the first vehicle is forwarded, the conveyor 6 slides forward to reduce its protrusion so that it is conveniently constructed for movement. Moreover, those belt conveyors can be replaced by a single belt conveyor which is suitably sloped.

Gas cylinder tables 67 are vertically movably attached through lifts 66 to the two side frames 65 of the self-propelled body 1'.

Figure 6:
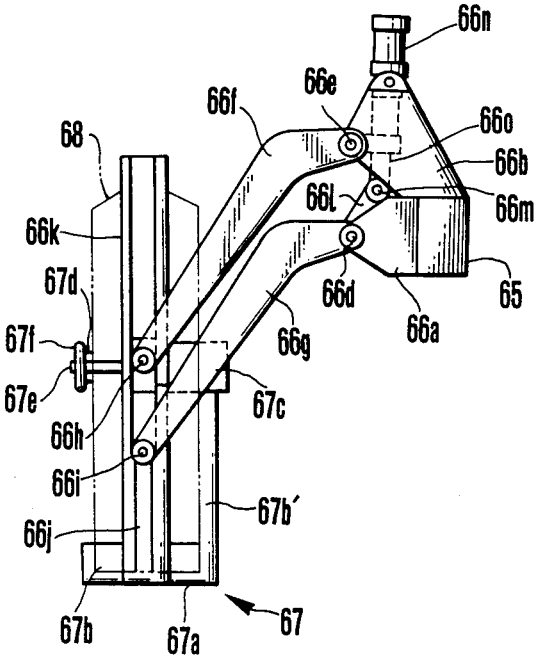
FIG. 6 is a front elevation showing the state in which a gas cylinder table is moved down by means of the lift.
Figure 5:
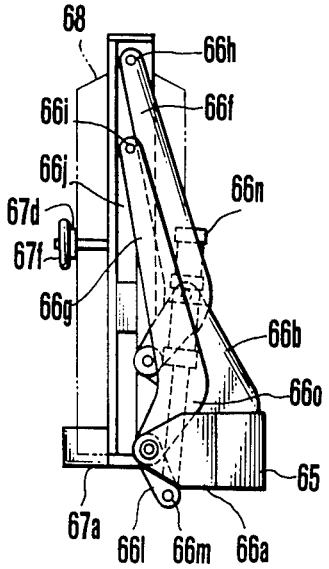
FIG. 5 is a front elevation showing a lift.
Figure 7:
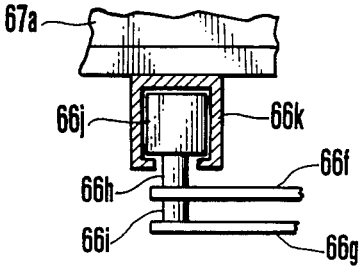
FIG. 7 is an enlarged top plan view showing a portion of a guide frame.

The lifts 66 are paired and attached symmetrically at a predetermined spacing in the longitudinal direction of the two side frames 65. FIG. 5 is a front elevation showing the lift 66 located at the righthand side and ahead in running direction of the self-propelled body 1', and FIG. 6 is a front elevation showing the state in which the gas cylinder table 67 is dropped to the ground.

The lift 66 has its mounting bases **66*a*, 66*b* and 66*c* fixed symmetrically at a predetermined spacing in the longitudinal direction of the frame 65. A lower arm 66*g* is hinged through a pin 66*d* to the outer mounting base 66*a* whereas an upper arm 66*f* is hinged through a pin 66*e* to the middle mounting base 66*b*. In the middle of the middle mounting base 66*b* and the inner mounting base 66c, there is erected a lifting cylinder 66n which has its rod 66o** directed downward.

The aforementioned upper and lower arms 66f and 66g are formed to have a horizontally bent shape in their front views and a vertically bent shape when their leading end portions are dropped around the pins 66d and 66e, respectively.

To the base end portion of the aforementioned lower arm 66g, there is attached to an actuating arm 66l which has its leading end portion connected through a pin 66m to the end of the rod 66o of the aforementioned lifting cylinder 66n so that the lower arm 66g is swung up and down by the piston action of the lifting cylinder 66n.

The upper and lower arms 66f and 66g have their leading end portions hinged, in their parallel states, to a sliding member 66j through pins 66h and 66i, and said sliding member 66j is vertically slidably fitted in guide frames 66k.

Moreover, these guide frames 66k are erected at both the longitudinal end portions of the gas cylinder table 67.

This gas cylinder table 67 has its slim base 67a surrounded by frames 67b and 67b', the inner one 67b' of which is formed to have one half height of that of bas bombs 68. From the upper end portion of the inner surrounding frame 67b', there protrudes outward an arm member 67c which is connected to the guide frames 66k erected at both the longitudinal end portions of the aforementioned base 67a.

From the upper end portion of the aforementioned inner surrounding frame 67b', moreover, there protrude a plurality of fastening levers 67e which extend in parallel with the arm member 67c and at a predetermined spacing in the longitudinal direction of the base 67a. A thrust plate 67d is fitted on and a fastening ring 67f is screwed on the leading end portion of each of the fastening levers 67e.

What is shown in FIG. 5 with the construction thus far described is the state in which the gas cylinder table 67 is elevated to a fixed position on the self-propelled truck body 1'. When the piston rod 66o of the lifting cylinder 66n is contracted, the leading end of the lower arm 66g is moved down together with the upper arm 66f hinged to the sliding member 66j so that the guide frame 66k and the base 67a fixed to the former are dropped to the ground in accordance with the downward movement of the sliding member 66j. At the drop stage, the thrust plate 67f is disengaged to place the gas cylinders 68 and so forth on the base 67a. The thrust plate 67f is fitted on the fastening levers 67e, and the fastening ring 67f is screwed and fastened to the leading end portion of the fastening levers 67e which protrude outward from the thrust plate 67f. Then, the gas cylinders 68 and so forth are fastened and fixedly clamped between the inner surrounding frame 67b' and the thrust plate 67f. If the piston rod 66o of the lifting cylinder 66n is then extended, the gas bombs 68 and so forth can be lifted and fixed in the state shown in FIG. 5.

The aforementioned lifting cylinder 66n may be of either hydraulic or pneumatic type.

The aforementioned upper and lower arms 66f and 66g are hinged to the sliding member 66j but may be directly hinged to the guide frame 66k. With the sliding member 66j, incidentally, the base 67a can be dropped without any trouble even if its drop position is higher or lower than the general road surface.

Figure 8:
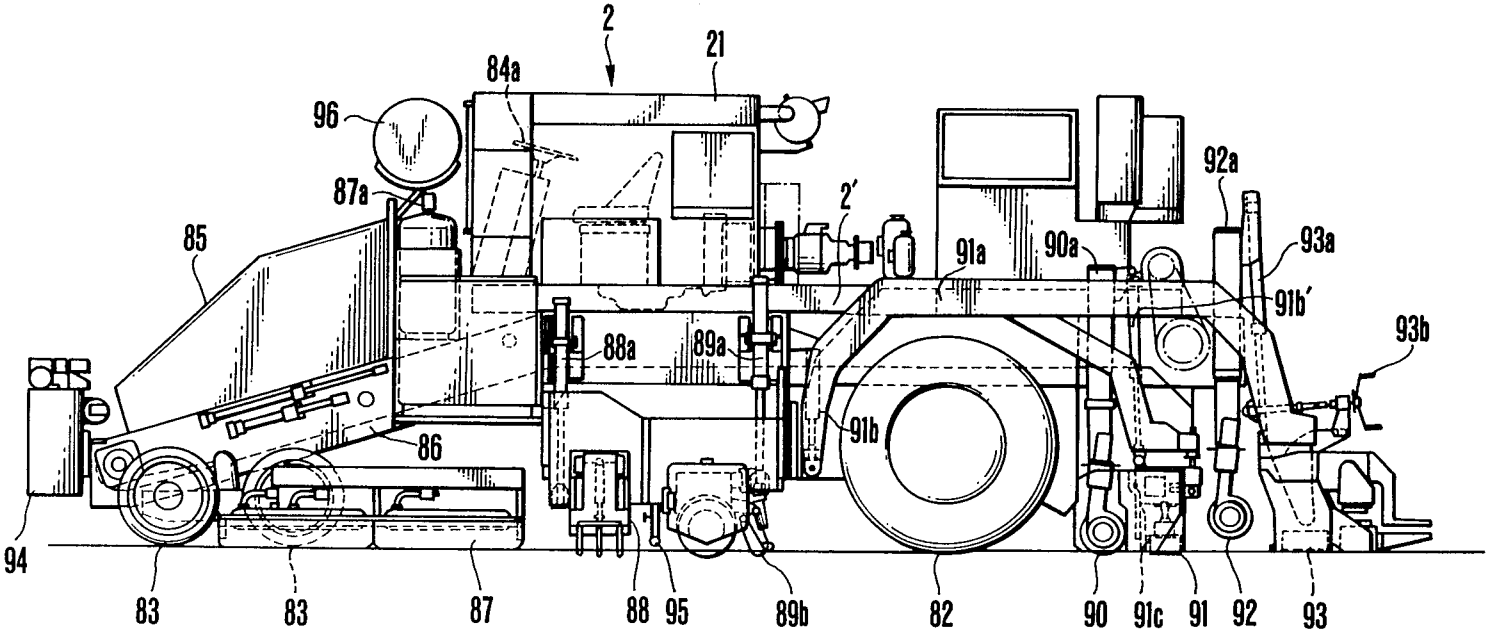
FIG. 8 is a side elevation showing a second working truck.

In FIG. 8, the second working truck is equipped with drive wheels 82 and smaller front wheels 83 borne on two axles, both wheels 82 and 83 of which can be steered by means of a steering wheel 84a.

A truck body 2' has its front upper portion sloped downward to the front and carries a hopper 85 and a slidable bar feeder 86 of known type, which extends from below said hopper 85 to the back of the body 2' to feed backward the paving material received from the hopper 85.

Bellow the body 2', there are disposed between the front wheels 83 and the drive wheels 82 powdery oil-absorber scattering means 94, a heater 87, a scarifier 88, softening agent scattering means 95, and a rotor 89 which are arranged in the order recited from the front of the body 2' toward the rear thereof. The powdery oil-absorber scattering means 94 scatters the oil-absorber, which has an action to absorb light oil from the asphalt, into the gaps of the powder. As seen in a top plan view, said oil-absorber scattering means is disposed vertically with respect to the running direction of the truck to scatter the oil-absorber uniformly over the road surface by means of a screw conveyor and a slit which is opened to have a controllable opening. The heater 87 is of the infrared ray type using a gas burner to heat the road surface paved with the asphalt. Reference numeral 87a indicates gas cylinders.

The aforementioned scarifier 88 has three pawls which are arranged zigzag at its front and back to have their tips submerged below the road surface to dig up the same. During the non-operation, however, the scarifier 88 is constructed such that it can be lifted by means of a cylinder 88a.

The softening agent scattering means 95 is one for scattering a softening agent for renewing the asphalt which has aged to become hard. This means 95 controls the scattering amount of the softening agent, which is supplied via a flexible tube from a softening agent reservoir 96 attached removably, by means of an electromagnetic valve which is disposed in the vicinity of the nozzle thereof.

The aforementioned rotor 89 is of the type with rotating drum and has its lower end submerged below the road surface by a spring force to tamp and stabilize the road surface which has been dug up by the scarifier 88. The rotor 89 can be moved up by means of a cylinder 89a. Reference numeral 89b indicates a float.

At a rear portion of the truck body 2', there are arranged a first screw spreader 90, a first screed 91, a second screw spreader 92 and a second screed 93 in the recited order, from the front toward the rear.

The first screw spreader 90 is composed of two halves which are driven sideway of the body 2' and driven at both the sides so that it is sloped to have its center higher than its two sides while supporting its lower faces submerged below the road surface. During the non-operation, the first screw spreader 90 can be moved up by means of a cylinder 90a. When in operation, the screw spreader 90 primarily spreads the paving material, which has flown forward below the second screw spreader 92, to a predetermined width over the paved surface, which has been paved by breaking, rolling and stabilizing the asphalt paved surface dug up by the scarifier 88 by the action of the rotor 89, so that the paving material is moved and spread from the roadside ends to the central portion in a manner to have a raised central portion.

The first screed 91 is supported at both the sides of the body by means of an arm 91a having a generally inverted "U" side, which has both its front and rear end portions supported by the body vertically and movably by means of cylinders 91*b* and 91*b'* and its rear end portion equipped with the screed 91. This screed 91 can be moved up and down by moving the arm 91*a* up and down as a whole or the rear portion of the same only. The screed 91 has a built-in heater 91*c* and is equipped at both its side end portions with no-shown wideners which can slide inward and outward. The screed 91 has its lower end face made higher at the central portion than both the two end portions in accordance with the slope of the road surface. As a result, the first screed thus constructed can have its height adjusted in accordance with the undulations of the road surface to effect the primary tamping.

The aforementioned second screw spreader 92 is made similar to the first one 90 and can have its mounted level higher than the road surface and adjusted by means of a cylinder 92*a*.

The aforementioned second screed is made and attached in a known manner and is equipped with a height adjusting cylinder 93*a* and an adjusting lever 93*b*.

The paving material located between the first and second screeds 91 and 93 on the road surface tamped by the first screed 91 is spread to have a predetermined width and thickness by the action of the second screw spreader 92. In this case, the spreaded surface of the paved road is higher than the predetermined level but is tamped and finished to that level by the action of the second screed 93 located at the back.

The present invention can enjoy the following effects:

(1) In the first working truck of the present invention, as has been described hereinbefore, the gas cylinder tables are attached to the self-propelled track through the lift so that they can be mounted or demounted by the action of the lift. As a result, the gas cylinder or cylinders can be simply and efficiently replaced even at the site where no crane is installed.

(2) With the construction thus far described, the second working truck has the following excellent effects:

(a) In case the paved surface is dug deeper than the upper faces of the side grooves or the like and is additionally paved with the new paving material, the first screed can be dropped to a lower position than the road surface so that it can prevent the paving material from flowing out forward.

(b) The paving material having flown forward below the first screed, if any, is prevented from flowing toward the roadside ends by the action of the first screw spreader so that it can be primarily spreaded to the predetermined width and thickness.

(c) The first screw spreader is of the two-side drive type so that its one side can be driven in case the remedy is conducted at one side from the widthwise center of the road.

(d) The first screed is dropped to a lower level than the road surface so that the primary tamping can be executed at the accordingly low level in case the paving material is spread and tamped thick. This makes it possible to increase the spreading and tamping speeds.

(e) If the rotor is raised, the paved surface can be dug up by the scarifier and broken up and spread by the first screw spreader until it can be tamped and stabilized by the first screed.

(f) The first screed has the built-in heater for heating the primarily tamped surface so that no trouble arises in the adhesiveness between the primarily tamped surface and the secondarily tamped layer.

(g) The present apparatus of the present invention has both the functions of the paved road surface reproducing apparatus and the asphalt finisher so that it can efficiently remedy the rutted and/or separated surface of the road paved with the asphalt.

What is claimed is:

1. A paved road surface reproducing apparatus comprising:

a first self-propelled, steerable working truck carrying thereon a road surface heater for heating the surface of a road paved with a bituminous material; a pair of gas cylinder tables disposed at the two side portions of said first working truck and movable upward and downward; a first hopper for receiving a bituminous mixture from the outside; and a first conveyor for conveying said bituminous mixture from said first hopper to the rear portion of said first working truck; and a second self-propelled, steerable working truck carrying thereon a second hopper for receiving said bituminous mixture from said first conveyor; a second conveyor for conveying said bituminous mixture backward from said second hopper; scattering means for scattering a powdery oil-absorber; a road surface heater having a width which is substantially equal to and a length which is less than that of the road surface heater of the first truck so as to have a smaller maximum heat capacity; a scarifier; softening agent scattering means; and a rotor adapted to have a portion thereof at a level below said road surface, and arranged in tandem in rear portions of its body with: a first screw spreader adapted to have its lower end face at a level below a level of said road surface; a first screed adapted to have its lower end face at a level below a level of said road surface; a second screw spreader; and a second screed such that they are disposed in the order recited from the front toward the rear of said second working truck.

* * * * *